United States Patent [19]

Davidson

[11] Patent Number: 4,869,464

[45] Date of Patent: Sep. 26, 1989

[54] HEAVY DUTY STAPLE REMOVER

[76] Inventor: Frank E. Davidson, 22222 Craggyview St., Chatsworth, Calif.

[21] Appl. No.: 235,168

[22] Filed: Aug. 23, 1988

[51] Int. Cl.[4] ..... B25C 11/00

[52] U.S. Cl. ..... 254/28; 29/268

[58] Field of Search ..... 254/28; 29/268

[56] References Cited

U.S. PATENT DOCUMENTS

| | | | |
|---|---|---|---|
| D. 144,955 | 6/1945 | Yerkes . | |
| D. 157,999 | 4/1950 | Pankonin . | |
| D. 201,731 | 7/1965 | Olney . | |
| D. 202,238 | 9/1965 | Kohen et al. . | |
| 2,033,050 | 3/1936 | Pankonin . | |
| 2,750,148 | 6/1956 | Burbank | 254/28 |
| 3,241,814 | 3/1966 | Forte . | |
| 3,293,673 | 12/1966 | Olney . | |
| 3,299,449 | 1/1967 | Olney . | |
| 4,575,049 | 3/1986 | Fister . | |

FOREIGN PATENT DOCUMENTS

| | | | |
|---|---|---|---|
| 2458361 | 2/1981 | France | 254/28 |

*Primary Examiner*—Frederick R. Schmidt
*Assistant Examiner*—David A. Holmes
*Attorney, Agent, or Firm*—Spensley Horn Jubas & Lubitz

[57] ABSTRACT

A staple removing device includes a pair of jaws having portions which are provided at an angle with respect to a corresponding pair of handles. The pair of jaws are pivotable about a common pivot pin. A palm rest extends from a bracket which is attached to a jaw and a corresponding handle. In operation, the palm rest is positioned generally in line with the jaws and a staple to be removed. Additionally, the palm rest is positioned so that an operator can comfortably apply a pushing force thereon with one hand, while gripping the pair of handles with the other hand. The palm rest is further positioned so that a pushing force applied thereto, by an operator's hand, is transferred along a substantially straight line toward a staple to be removed.

1 Claim, 3 Drawing Sheets

HEAVY DUTY STAPLE REMOVER

BACKGROUND OF THE INVENTION

1. Field of the Invention

The present invention relates generally to a staple removing device and more particularly to a heavy duty staple removing device.

2. Description of Related Art

Many heavy duty staple removing devices, such as that disclosed in the patent to Olney, U.S. Pat. No. 3,299,449, issued Jan. 24, 1967, have a set of substantially L-shaped jaws which include jaw portions disposed at an angle (approximately 90 degrees) with respect to a corresponding set of handles. Such "angled" designs provide excellent leverage capabilities for removing deeply embedded or otherwise intractable staples. However, such "angled" designs do not transfer the force needed to push a jaw tip underneath a staple as well as nonangled (or "straight") designs.

Nonangled or "straight" staple removing devices, such as disclosed in the patent to Pankonin, U.S. Pat. No. 2,033,050, issued Mar. 3, 1936, are provided with a pair of handles which extend in a substantially straight manner with respect to a pair of jaws. As best shown in FIG. 3 of the Pankonin patent, when operating to remove a staple, the handles are arranged in a substantially straight line with respect to the jaws and the staple. Unlike "angled" staple removing devices, with the nonangled, or "straight", design, manual force applied to the handles and directed toward the staple to be removed is transferred to the jaws along a generally straight line formed between the handles, the jaws, and the staple. In this regard, forces applied to the handles of a "straight" staple removing device for pushing the jaws toward and under a staple are transferred to the jaws in a more efficient manner than such forces applied to the handles of an "angled" staple removing device. Thus, the jaws of a "straight" staple removing device tend to be more easily pushed toward and underneath deeply embedded staples, or staples embedded in relatively hard materials, than the jaws of an "angled" staple removing device.

SUMMARY OF THE INVENTION

It is therefore an object of the present invention to provide a staple removing device having excellent leverage capabilities and which includes means for allowing an operator to easily push the pair of jaws toward and underneath a deeply embedded staple.

It is also an object of the present invention to provide a staple removing device having means for allowing an operator to apply a force directed in a substantially straight line for pushing the jaws toward and under a staple to be removed.

It is further an object of the present invention to provide a staple removing device which accomplishes the above objects and is further provided with a pair of handles arranged in an angle with respect to the jaws.

These and other objects are accomplished, according to the present invention by providing a staple removing device having a palm rest which is operable for receiving a force applied thereto by an operator's hand. According to an embodiment of the present invention, a staple removing device includes a pair of jaws which are provided at an angle with respect to a corresponding pair of handles. The pair of jaws are pivotable about a common pivot pin. A palm rest extends from a bracket which is attached to a jaw and a corresponding handle. In operation, the palm rest is positioned in line with the jaws and a staple to be removed. Additionally, the palm rest is positioned so that an operator can comfortably apply a pushing force thereon with one hand, while gripping the pair of handles with the other hand. The palm rest is further positioned so that a pushing force applied thereto, by an operator's hand, is transferred along a substantially straight line toward a staple to be removed. In this manner, a force needed to push a jaw of the staple remover under a deeply imbedded staple is efficiently transferred from the palm rest to the jaw. The force applied by the operator's hand onto the palm rest is substantially equal to the force applied to the jaw and toward the staple.

In this regard, the staple removing device of the above embodiment possesses all the advantages of a conventional staple removing device having jaws disposed at an angle with respect to corresponding handles, and further provides means for allowing an operator to apply a force along a substantially straight line toward a staple to be removed.

BRIEF DESCRIPTION OF THE DRAWINGS

Further details are explained below with the aid of the exam in the attached drawings in which.

DESCRIPTION OF THE PREFERRED EMBODIMENTS

Figure 1:
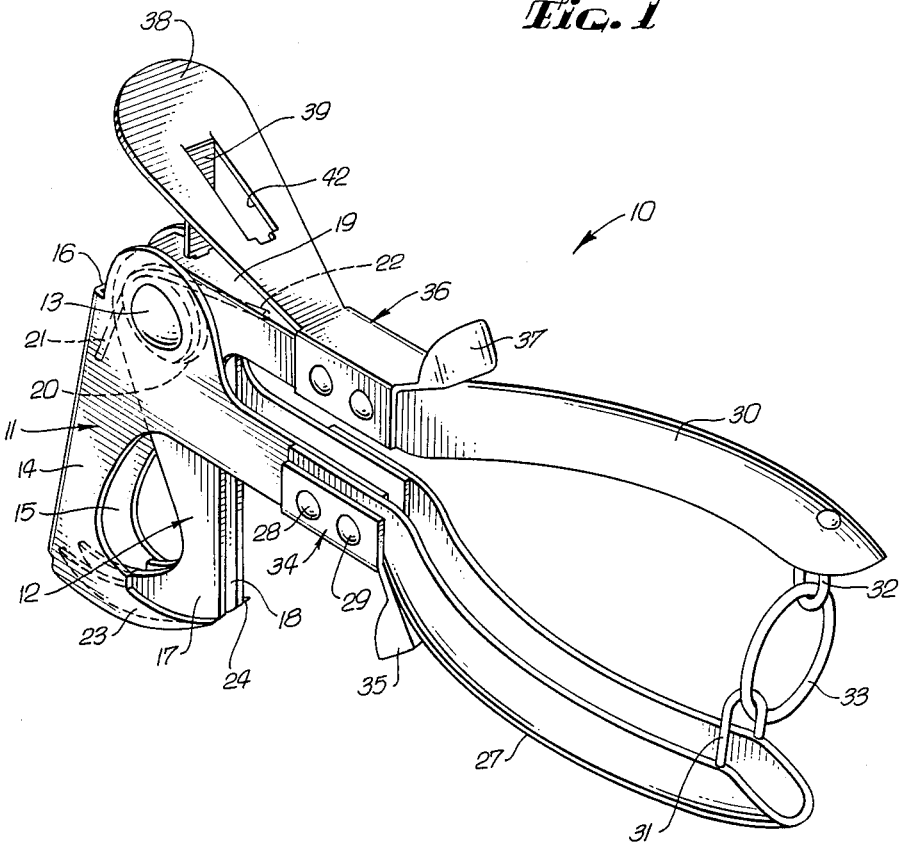
FIG. 1 is a perspective view of a heavy duty staple remover according to an embodiment of the present invention.
Figure 2:
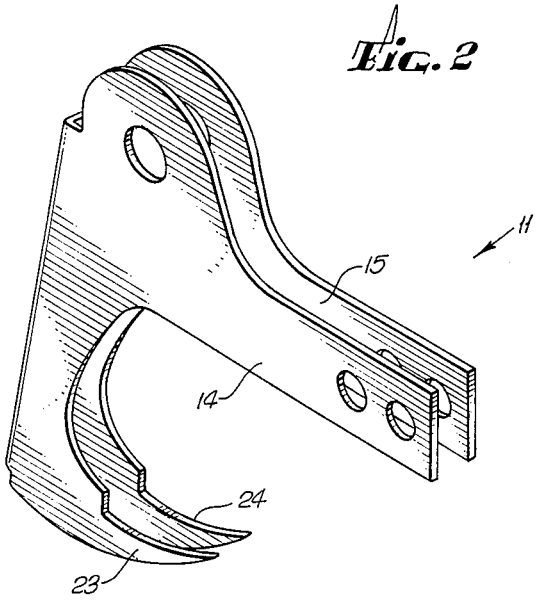
FIG. 2 is a perspective view of the jaw 11 of the embodiment of FIG. 1.
Figure 3:
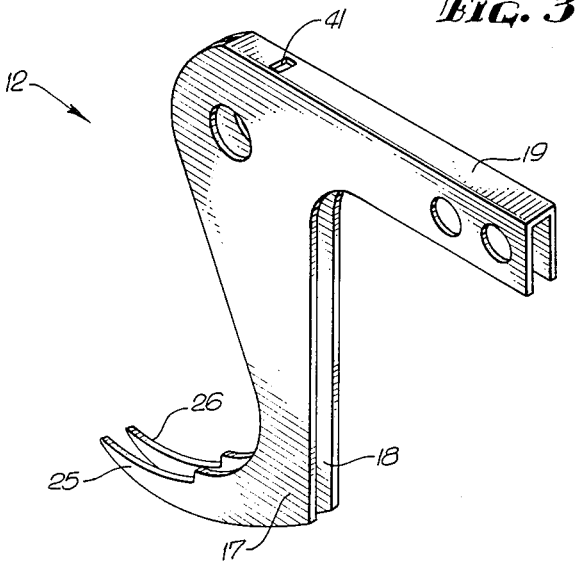
FIG. 3 is a perspective view of the jaw 12 of the embodiment of FIG. 1.

Referring to the embodiment of FIG. 1, a staple remover 10 is shown as having a pair of substantially L-shaped jaws 11 and 12. The jaws 11 and 12 are pivotable about a pin 13. Jaw 11, as shown in FIG. 2, disassembled from the staple remover 10, is provided with two sides 14 and 15 joined by a bridge portion 16. A portion of each side 14 and 15 of jaw 11 is disposed at an angle with respect to a handle 30. Jaw 12, as shown in FIG. 3, disassembled from the staple remover 10, is provided with two sides 17 and 18 which are joined by a bridge portion 19. A portion of each side 17 and 18 of jaw 12 is disposed at an angle with respect to a handle 27. Extending from the portion of sides 14 and 15 which is disposed at an angle with respect to handle 30 are sharp claws 23 and 24, respectively. Similarly, extending from sides 17 and 18 are sharp claws 25 and 26, respectively. As shown in FIG. 1, the sides 17 and 18 of jaw 12 are spaced at a smaller distance than the sides 14 and 15 of jaw 11. In this manner, when jaws 11 and 12 are in a closed position, as in FIG. 1, the claws 25 and 26 of jaw 12 fit between the sides 14 and 15 of jaw 11.

A torsion spring 20 is disposed about pin 13 and is held within sides 17 and 18 of jaw 12. The torsion spring 20 has arms 21 and 22 which bear against bridge portions 16 and 19, respectively, so as to urge jaws 11 and 12 apart.

A handle 27 is connected to jaw 11 by rivets 28 and 29. Other suitable means for connecting handle 27 to jaw 11 can be used in place of rivets 28 and 29. Alternatively, the handle 27 and jaw 11 can be formed as a unitary structure. A handle 30 is similarly connected or formed with jaw 12.

A first hook 31 is connected to a free end of the handle 27 and a second hook 32 is connected to a free end of the handle 30. A ring 33 is connected to the second hook 32 and is releasably connected to the first hook 31. When connected to the first hook 31, ring 33 secures the handles 27 and 30, and thus jaws 11 and 12, together in a closed position.

Figure 4:
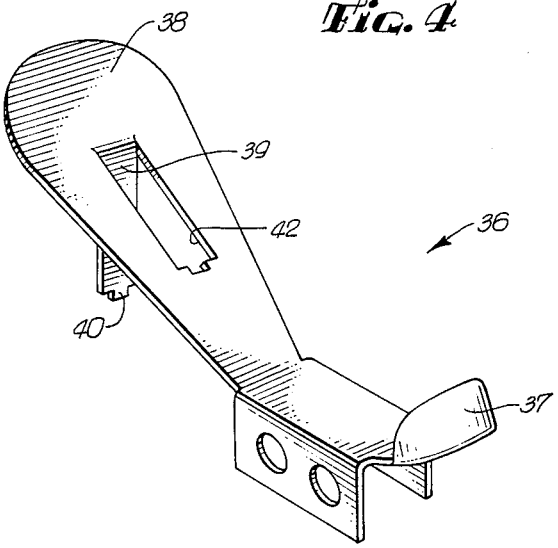
FIG. 4 is a perspective view of the bracket 36 and palm rest 38 of the embodiment of FIG. 1.
Figure 5:
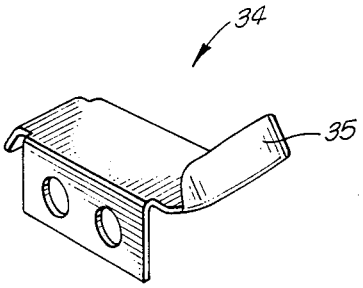
FIG. 5 is a perspective view of the bracket of the embodiment of FIG. 1.

Also shown in the embodiment of FIG. 1 is a bracket 34 secured to the handle 27 and jaw 11 with rivets 28 and 29. Other suitable securing means may be used in place of rivets 28 and 29. A second bracket 36 is similarly secured to the handle 30 and jaw 12. Extending from the bracket 34 is a guard 35 and extending from the bracket 36 is a similar guard 37. Bracket 35 is shown in FIG. 4, disassembled from the staple remover 10, while bracket 34 is shown in FIG. 5, disassembled from the staple remover 10.

Extending from the bracket 36 is a palm rest 38. Palm rest 38 comprises a flat plate-like member which is wider at greater distances from the bracket 36 and is rounded at the free end. The palm rest 38 extends generally over jaws 11 and 12, in a manner such that, during a staple removing operation, the palm rest is generally in line with the claws 23–26 and the staple. A support strut 39 is provided between the palm rest 38 and the bridge portion 19 of jaw 12. The support strut operates to support the palm rest in the position described above, and to transfer a force applied to the palm rest (i.e., by an operator's palm) to the jaws 11 and 12.

The support strut 39 of the illustrated embodiment is formed from a cut and bent portion of the palm rest 38. An aperture 42 is, thereby, formed in the palm rest 38. Extending from one end of the support strut 39 is a peg 40. The peg 40 is shaped to fit into an aperture 41 (shown in FIG. 3) formed in the bridge portion 19 of jaw 12, to thereby secure the support strut 39 to the jaw 12. Other suitable means for providing and securing the support strut 39 are also within the scope of the present invention. Furthermore, an alternative embodiment may be provided without the support strut 39.

The palm rest 38 is positioned over jaws 11 and 12 in a manner which allows an operator to comfortably place the palm of one hand thereon while gripping the handles 27 and 30 with the other hand. In this manner, the operator can easily push the jaws 11 and 12 toward a deeply embedded staple (not shown) with the palm of one hand, and, at the same time, can squeeze and manipulate the handles 27 and 30 with the other hand.

The force applied to the palm rest 38 by an operator's palm, and transferred to the jaws 11 and 12 by the support strut 39, is directed toward a staple to be removed (now shown) in a substantially straight line. In this regard, the claws of jaws 11 and 12 can be easily forced toward and underneath a deeply embedded staple (not shown). By providing the palm rest 38 in a position which, during staple removing is in a substantially straight line with the claws of jaws 11 and 12 and the staple, a maximum amount of the force applied to the palm rest 38 is transferred in the direction of a staple to be removed (not shown). That is, the force applied by an operator's palm on the palm rest 38 is most efficiently transferred to the jaws 11 and 12 when the force is transferred, as in the embodiment of FIG. 1, through a substantially straight line.

The staple removing tool 10, shown in the embodiment of FIG. 1, therefore, provides all the advantages of a conventional "angled" staple remover (a staple remover having a pair of handles extending at an angle from a corresponding pair of jaws). Furthermore, the staple removing tool 10, shown in the embodiment of FIG. 1, provides means for applying forces which are efficiently transferred in the direction of the staple to be removed (not shown) and along a straight line formed between the claws of jaws 11 and 12 and the staple. In this respect, the staple removing tool of the embodiment in FIG. 1 provides the advantages of a conventional "straight" staple remover (a staple remover having a pair of handles extending from a corresponding pair of jaws in a nonangled or straight manner). As a result, the staple removing tool shown in the embodiment of FIG. 1 is superior to the conventional "angled" and "straight" staple removing tools.

While the description above shows particular embodiments of the present invention, it will be understood that many modifications may be made without departing from the spirit thereof. Depending claims are intended to cover such modifications as would fall within the true scope and spirit of the present invention. The presently disclosed embodiments are, therefore, to be considered in all respects as illustrative and not restrictive, the scope of the invention being indicated by the appending claims, rather than the foregoing description, and all changes which come within the meaning and range of equivalency of the claims are therefore intended to be embraced therein.

What is claimed:

1. A staple removing tool operable for removing a staple from a material to which it is attached, said staple removing tool comprising:

a first handle;

a second handle;

a first jaw connected with said first handle, said first jaw having a first portion provided at an angle with respect to said first handle, said first jaw having a claw extending from said first portion;

a second jaw connected with said second handle, said second jaw having a second portion provided at an angle with respect to said second handle, said second jaw having a claw extending from said second portion;

a pivot pin about which is first and second jaws are pivotable;

a bracket connected to said first jaw; and a palm rest extending from said bracket in a direction away from the first handle, the palm rest having a substantially flat planar portion extending over the pivot pin and aligned at an acute angle with respect to the pivot pin, said claw portions of said first and second jaws and the staple, thereby to enable a force to be applied in a direction toward the staple to force the claw portions to imbed in the material adjacent the staple so as to facilitate the claw portions in engaging the staple during a staple removing operation; and a support strut provided between said palm rest and said first jaw for transmitting the force applied to the palm rest to the claw portions.

* * * * *